US009371205B2

(12) United States Patent
Hattori

(10) Patent No.: US 9,371,205 B2
(45) Date of Patent: Jun. 21, 2016

(54) SHEET PROCESSING APPARATUS AND IMAGE FORMING SYSTEM

(71) Applicant: KONICA MINOLTA, INC., Chiyoda-ku, Tokyo (JP)

(72) Inventor: Masato Hattori, Hino (JP)

(73) Assignee: KONICA MINOLTA, INC., Tokyo (JP)

( * ) Notice: Subject to any disclaimer, the term of this patent is extended or adjusted under 35 U.S.C. 154(b) by 36 days.

(21) Appl. No.: 14/473,484

(22) Filed: Aug. 29, 2014

(65) Prior Publication Data

US 2015/0065324 A1 Mar. 5, 2015

(30) Foreign Application Priority Data

Sep. 5, 2013 (JP) ..... 2013-184044

(51) Int. Cl.

| | |
|---|---|
| ***B65H 5/32*** | (2006.01) |
| ***B42C 19/08*** | (2006.01) |
| ***B65H 31/30*** | (2006.01) |
| ***B42B 9/04*** | (2006.01) |
| ***G03G 15/00*** | (2006.01) |

(52) U.S. Cl.

CPC .. *B65H 5/32* (2013.01); *B42B 9/04* (2013.01); *B42C 19/08* (2013.01); *B65H 31/3045* (2013.01); *G03G 15/6582* (2013.01); *B65H 2301/322* (2013.01); *B65H 2301/436* (2013.01); *B65H 2301/4479* (2013.01); *B65H 2301/51232* (2013.01); *B65H 2701/13212* (2013.01); *B65H 2801/27* (2013.01); *G03G 2215/00877* (2013.01)

(58) Field of Classification Search

CPC ..... B65H 5/32; B65H 2301/436; B65H 2301/4479

USPC ..... 270/52.14, 52.17, 52.26

See application file for complete search history.

(56) References Cited

U.S. PATENT DOCUMENTS

| | | | | |
|---|---|---|---|---|
| 6,708,967 | B1 * | 3/2004 | Trovinger et al. | 270/52.26 |
| 7,328,893 | B2 * | 2/2008 | Kawatsu et al. | 270/58.09 |
| 8,894,056 | B2 * | 11/2014 | Oshima | 270/52.26 |
| 2013/0038012 | A1 | 2/2013 | Kasuga et al. | |
| 2013/0154176 | A1 * | 6/2013 | Oshima | 270/37 |

FOREIGN PATENT DOCUMENTS

| | | | |
|---|---|---|---|
| JP | 2013035668 | A | 2/2013 |
| JP | 2013107747 | A | 6/2013 |

* cited by examiner

*Primary Examiner* — Leslie A Nicholson, III

(74) *Attorney, Agent, or Firm* — Holtz, Holtz & Volek PC

(57) ABSTRACT

A sheet processing apparatus including: a supporting section over which a sheet is hung to be supported from below, the sheet being folded in a mountain shape with a folding line formed at a central portion; a conveyance section which conveys the sheet supported by the supporting section in a direction orthogonal to the folding line in a horizontal plane including the folding line; a control section which controls a sheet conveyance operation by the conveyance section; a first pressing section which presses the folding line of the sheet supported by the supporting section from above; and a second pressing section which presses the sheet from a rear side in an advancing direction when the conveyance section conveys the sheet.

9 Claims, 10 Drawing Sheets

SHEET PROCESSING APPARATUS AND IMAGE FORMING SYSTEM

BACKGROUND OF THE INVENTION

1. Field of the Invention

The present invention relates to a sheet processing apparatus and an image forming system.

2. Description of Related Art

Conventionally, there is known an edge misalignment of a saddle-stitched booklet between a front surface and a back surface due to the folding line shifting from a central position when the saddle-stitched booklet is laid on its side for edge trimming.

In order to resolve such edge misalignment, there is suggested a method of trimming by holding the saddle-stitched booklet in a vertical state with the folding lineup in Japanese Patent Application Laid Open Publication No. 2013-35668, for example.

In such method, the edges of the saddle-stitched booklet enter a trimming section while the saddle-stitched booklet in the vertical state being held around the folding line by a holding section, and thus, the saddle-stitched booklet needs to be conveyed to the holding section in the vertical state after the half folding and saddle stitching processing.

For example, Japanese Patent Application Laid Open Publication No. 2013-107747 describes a technique for conveying the saddle-stitched booklet by using an XY table while placing the saddle-stitched booklet on a saddle-shaped placement section which supports the inferior angle portion at the folded part of the booklet from below. In Japanese Patent Application Laid Open Publication No. 2013-107747, a conveyance speed is controlled according to conditions of the saddle-stitched booklet in order to prevent the shifting of the saddle-stitched booklet during conveyance.

However, in Japanese Patent Application Laid Open Publication No. 2013-107747, since the saddle-stitched booklet is merely placed on the saddle-shaped placement section, the conveyance speed needs to be extremely low in order to prevent the saddle-stitched booklet from falling down and the folding line from shifting due to the conveyance operation, and thus, productivity is reduced.

SUMMARY OF THE INVENTION

The present invention has been made in consideration of the above problems in conventional techniques, and an object of the present invention is to provide a sheet processing apparatus and an image forming system which can convey a saddle-stitched booklet in a vertical state without reduction of productivity, fall down of the saddle-stitched booklet from a placement section and shifting of a folding line.

In order to achieve the above object, according to one aspect of the present invention, there is provided a sheet processing apparatus including: a supporting section over which a sheet is hung to be supported from below, the sheet being folded in a mountain shape with a folding line formed at a central portion; a conveyance section which conveys the sheet supported by the supporting section in a direction orthogonal to the folding line in a horizontal plane including the folding line; a control section which controls a sheet conveyance operation by the conveyance section; a first pressing section which presses the folding line of the sheet supported by the supporting section from above; and a second pressing section which presses the sheet from a rear side in an advancing direction when the conveyance section conveys the sheet.

Preferably, the sheet processing apparatus further includes a third pressing section which presses the sheet from a front side in the advancing direction when the conveyance section conveys the sheet.

Preferably, in the sheet processing apparatus, the control section makes the first pressing section retreat from the folding line at a position where sheet conveyance by the conveyance section is completed, and makes the second pressing section and the third pressing section press the sheet.

Preferably, the sheet processing apparatus further includes a trimming section which trims an edge of the sheet conveyed by the conveyance section.

Preferably, the sheet processing apparatus further includes a square back forming section which squeezes the folding line of the sheet conveyed by the conveyance section so as to be flat to form a square shape.

Preferably, the sheet processing apparatus further includes a clamping section which sandwiches, around the folding line, the sheet conveyed by the conveyance section and lifts up the sheet from the supporting section, and the supporting section includes a retreat section which contacts with the clamping section and retreats when the clamping section lifts up the sheet.

Preferably, in the sheet processing apparatus, the supporting section includes a detecting section which detects the sheet, the first pressing section presses the sheet supported by the supporting section at a position not overlapping the detecting section, and the control section makes the detecting section start detecting the sheet after the first pressing section presses the sheet.

According to another aspect of the present invention, there is provided an image forming system, including: an image forming apparatus which forms an image on a sheet; and the above sheet processing apparatus which is connected to the image forming apparatus, supports the sheet from below and conveys the sheet in a direction orthogonal to a folding line in a horizontal plane including the folding line, the sheet being folded in a mountain shape with the folding line formed at a central portion after the image forming apparatus forms the image on the sheet.

BRIEF DESCRIPTION OF THE DRAWINGS

The above and other objects, advantages and features of the present invention will become more fully understood from the detailed description given hereinbelow and the appended drawings which are given byway of illustration only, and thus are not intended as a definition of the limits of the present invention, and wherein.

DETAILED DESCRIPTION OF THE PREFERRED EMBODIMENT

An image forming system 1 according to an embodiment of the present invention will now be described with reference to the drawings.

Figure 1:
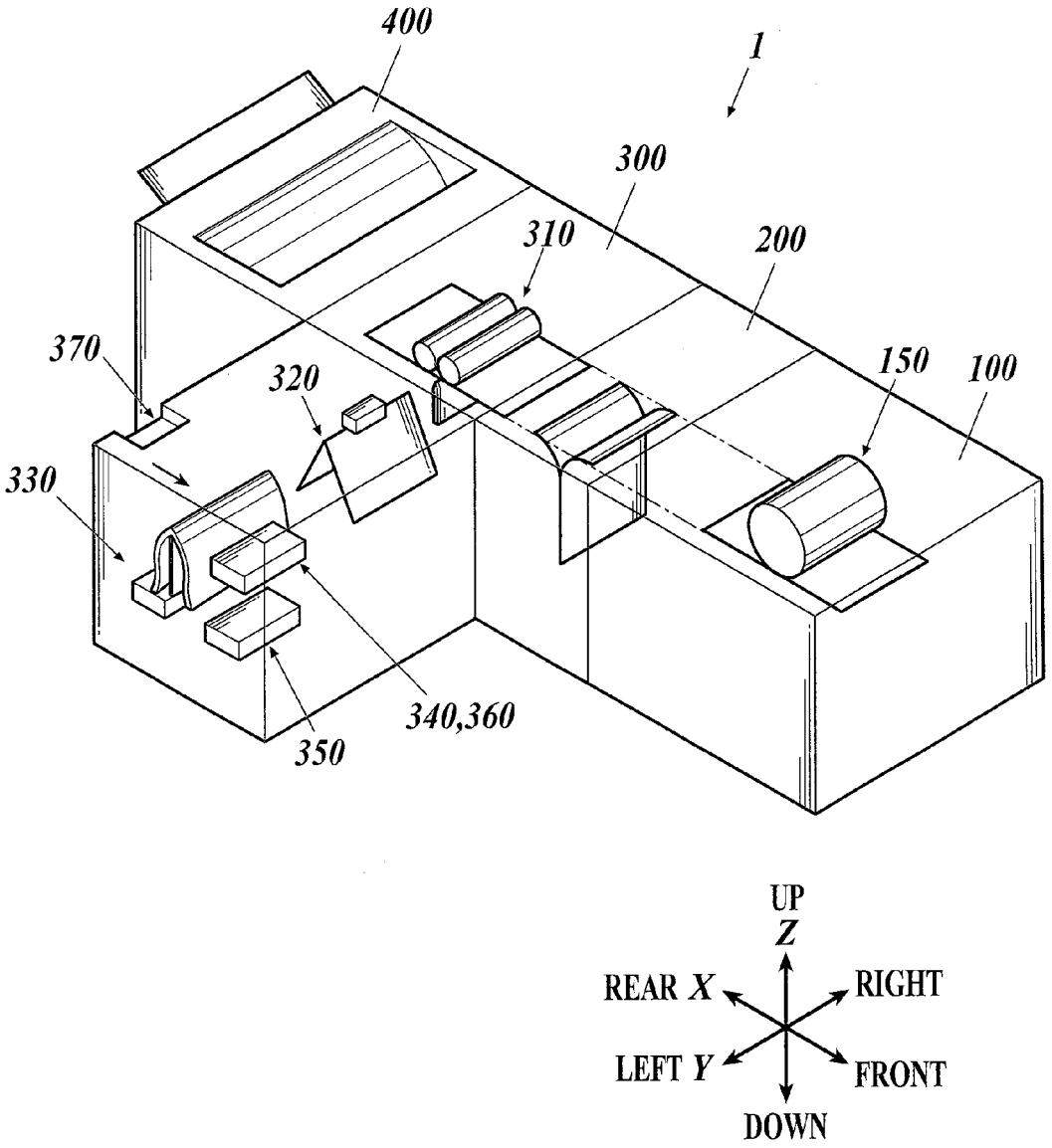
FIG. 1 is a schematic view illustrating an entire configuration of an image forming system.

FIG. 1 is a schematic view illustrating the entire configuration of the image forming system 1.

As shown in FIG. 1, the image forming system 1 includes an image forming apparatus 100, an intermediate conveyance apparatus 200, a sheet processing apparatus 300 and a side stitching apparatus 400.

In the following description, the vertical direction is referred to as Z direction; the direction of an array of the image forming apparatus 100, the intermediate conveyance apparatus 200, the sheet processing apparatus 300 and the side stitching apparatus 400 in FIG. 1 is referred to as X direction; and the direction orthogonal to both the X and Z directions is referred to as Y direction.

The X direction has front and rear sides, and the Y direction has right and left sides. The front side is upstream and the rear side is downstream when a sheet is conveyed in the image forming system 1. The right side is upstream and the left side is downstream when a sheet is conveyed for half folding and saddle stitching processing by the sheet processing apparatus 300.

The image forming apparatus 100 forms an image on a sheet of paper.

Specifically, the image forming apparatus 100 for forming an image on a sheet includes, for example, a conveyance section to extract and convey a sheet from the sheets stored as recording media from a sheet tray, a developing section to develop a toner image based on bitmap data onto a first transfer member such as a transfer roller, a first transfer section to transfer the toner image developed on the first transfer member onto a second transfer member such as a transfer drum 150, a second transfer section to transfer the toner image on the second transfer member onto the sheet conveyed by the conveyance section, a fixing section to fix the transferred toner image onto the sheet, and an ejecting section to eject the sheet after the fixation by the fixing section.

The image forming apparatus 100 passes the ejected sheet which has the image formed thereon to the intermediate conveyance apparatus 200. That is, the connection in the image forming system 1 allows the sheet ejected from the image forming apparatus 100 to be passed to the intermediate conveyance apparatus 200.

The intermediate conveyance apparatus 200 can temporarily stack a sheet and score and trim the sheet.

Specifically, the intermediate conveyance apparatus 200 includes, for example, a standby section (stacker) which conveys downward a sheet conveyed from the image forming apparatus 100 and makes the sheet stop once to standby with the sheet surface located along the Z direction; an alignment section which aligns the position of the sheet during the standby; a scoring section (creaser) which scores the aligned sheet; and a trimming section (slitter) which trims off margins in the sheet while conveying the scored sheet.

That is, the intermediate conveyance apparatus 200 once stops the sheet passed from the image forming apparatus 100 at the standby section, aligns the sheet with the alignment section, scores the sheet with the scoring section, and thereafter trims the margins in the sheet with the trimming section while conveying the scored sheet. Then, the intermediate conveyance apparatus 200 passes the sheet with the margins trimmed off by the trimming section to the sheet processing apparatus 300.

The intermediate conveyance apparatus 200 can also pass the sheet received from the image forming apparatus 100 to the sheet processing apparatus 300 without performing a part or all of the various processes by the intermediate conveyance apparatus 200.

The sheet processing apparatus 300 performs half folding that is folding the sheet in half (in two), saddle stitching that is stapling a predetermined number of stacked sheets which were folded in half to create a saddle-stitched booklet, trimming that is trimming the edges of the saddle-stitched booklet, square back forming that is forming a square back as the spine of the saddle-stitched booklet, and such like.

Specifically, the sheet processing apparatus 300 includes, for example, a half folding section 310 which folds the sheet received from the intermediate conveyance apparatus 200 in half along the Y direction, a saddle stitching section 320 which overlies the sheets folded in half by the half folding section 310 and inserts staples into the sheets to form a saddle-stitched booklet, a sheet conveyance mechanism 330 which receives the saddle-stitched booklet saddle-stitched by the saddle stitching section 320 and conveys the saddle-stitched booklet in the direction (X direction) orthogonal to the folding line in the horizontal plane, a clamping section 340 which sandwiches and holds, around the folding line, the saddle-stitched booklet conveyed by the sheet conveyance mechanism 330, a trimming section 350 which trims the edges of the saddle-stitched booklet held by the clamping section 340, a square back forming section 360 which forms a square back as the spine of the saddle-stitched booklet, and an ejecting section 370 which ejects the saddle-stitched booklet outside.

The sheet processing apparatus 300 can also pass the sheet received from the intermediate conveyance apparatus 200 to the side stitching apparatus 400 without performing a part or all of the various processes by the sheet processing apparatus 300.

The half folding section 310 includes, for example, a pair of half folding rollers and a plate-like folding knife which is located below the pair of half folding rollers along the Y-Z plane and movable so as to come between the half folding rollers.

The sheet received from the image forming apparatus 100 is conveyed to the position where the central portion of the sheet in the X direction faces the folding knife. Then, the folding knife enters between the half folding rollers and pushes the sheet into a nip section. Thus, the sheet is folded in half with the folding line along the Y direction at the position contacting the folding knife. That is, the sheet is in what is called a mountain fold shape (mountain-folded sheet) with the folding line up and the two ends of the sheet down.

The half-folded sheet is conveyed in a direction (Y direction) along the folding line by the conveyance section not shown in the drawings and reaches the saddle stitching section 320.

Figure 2:
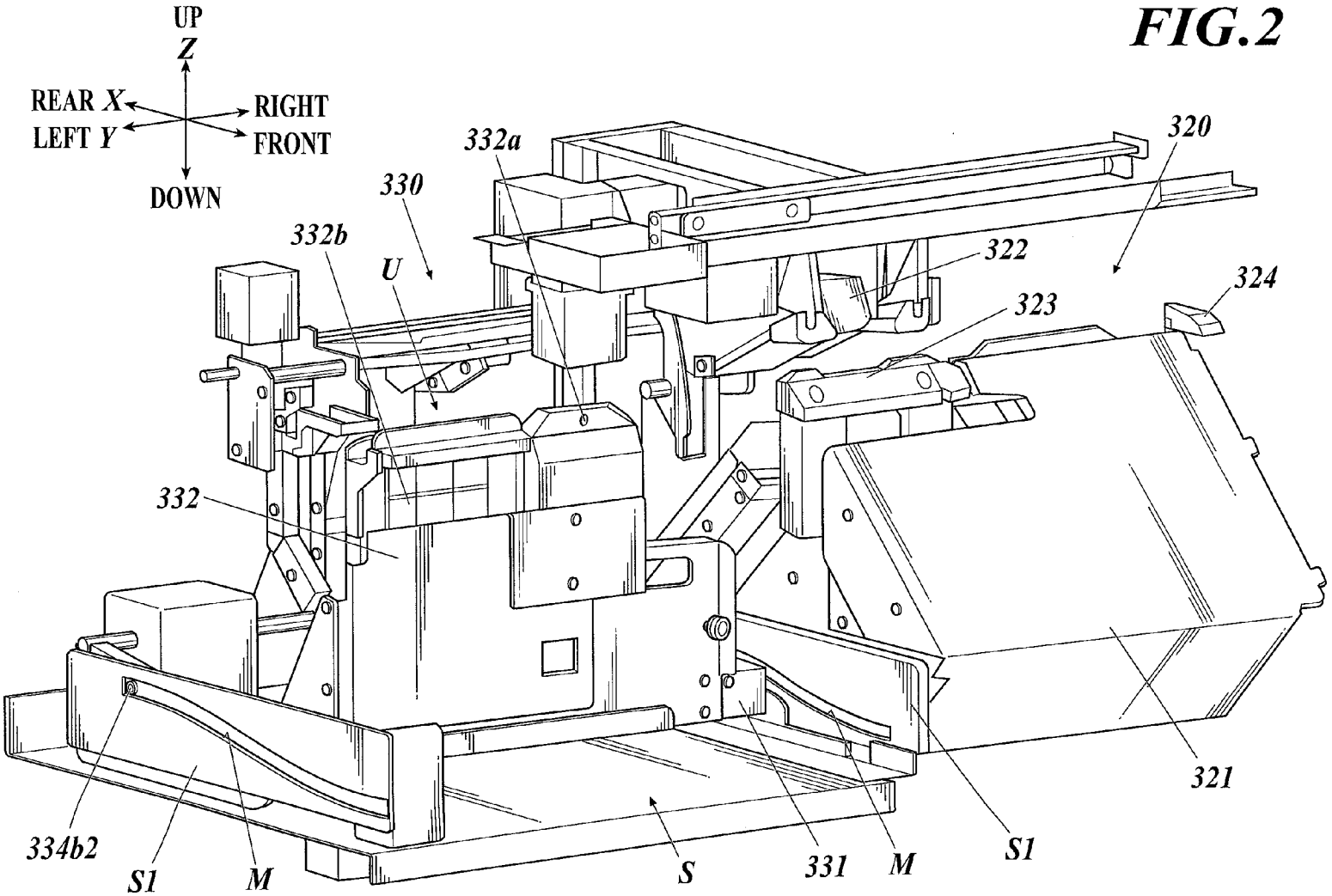
FIG. 2 is a perspective view showing an example of configurations of a saddle stitching section and a conveyance section of a sheet processing apparatus.
Figure 3:
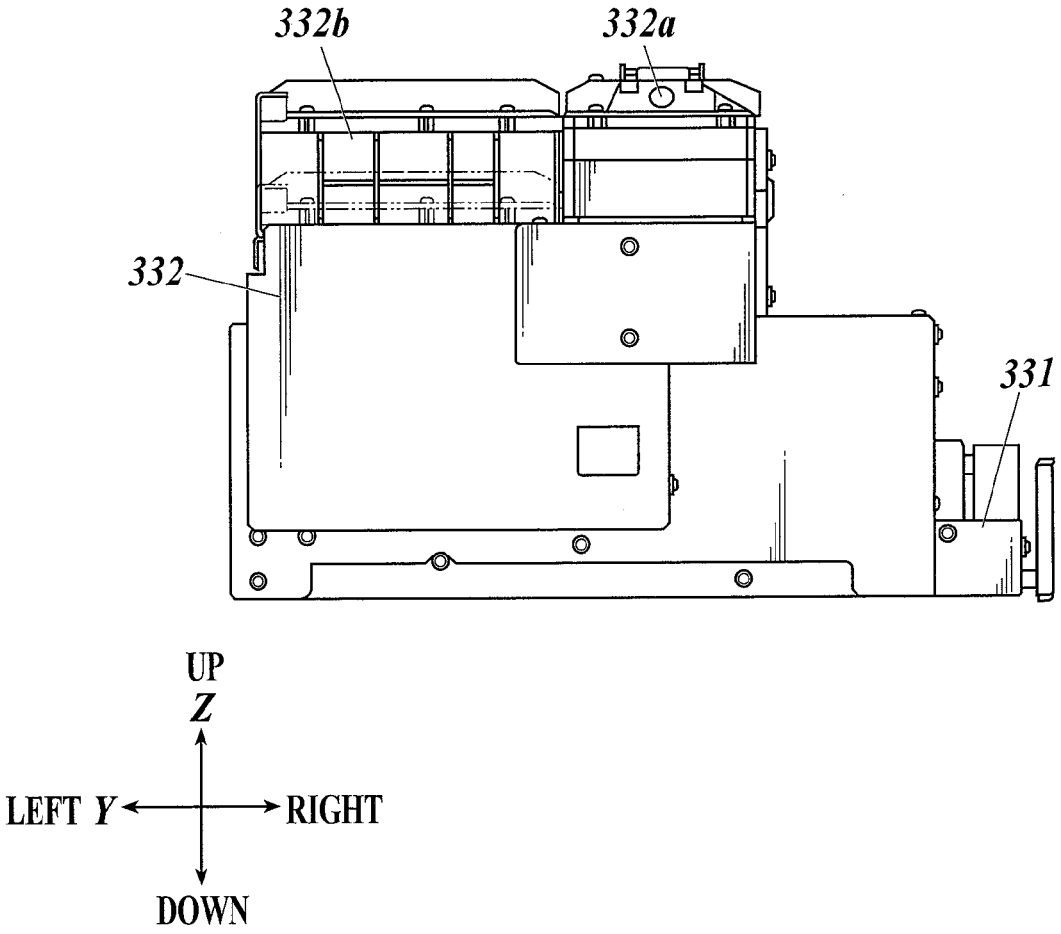
FIG. 3 is a view for explaining a configuration of a moving saddle of the conveyance section.
Figure 4:
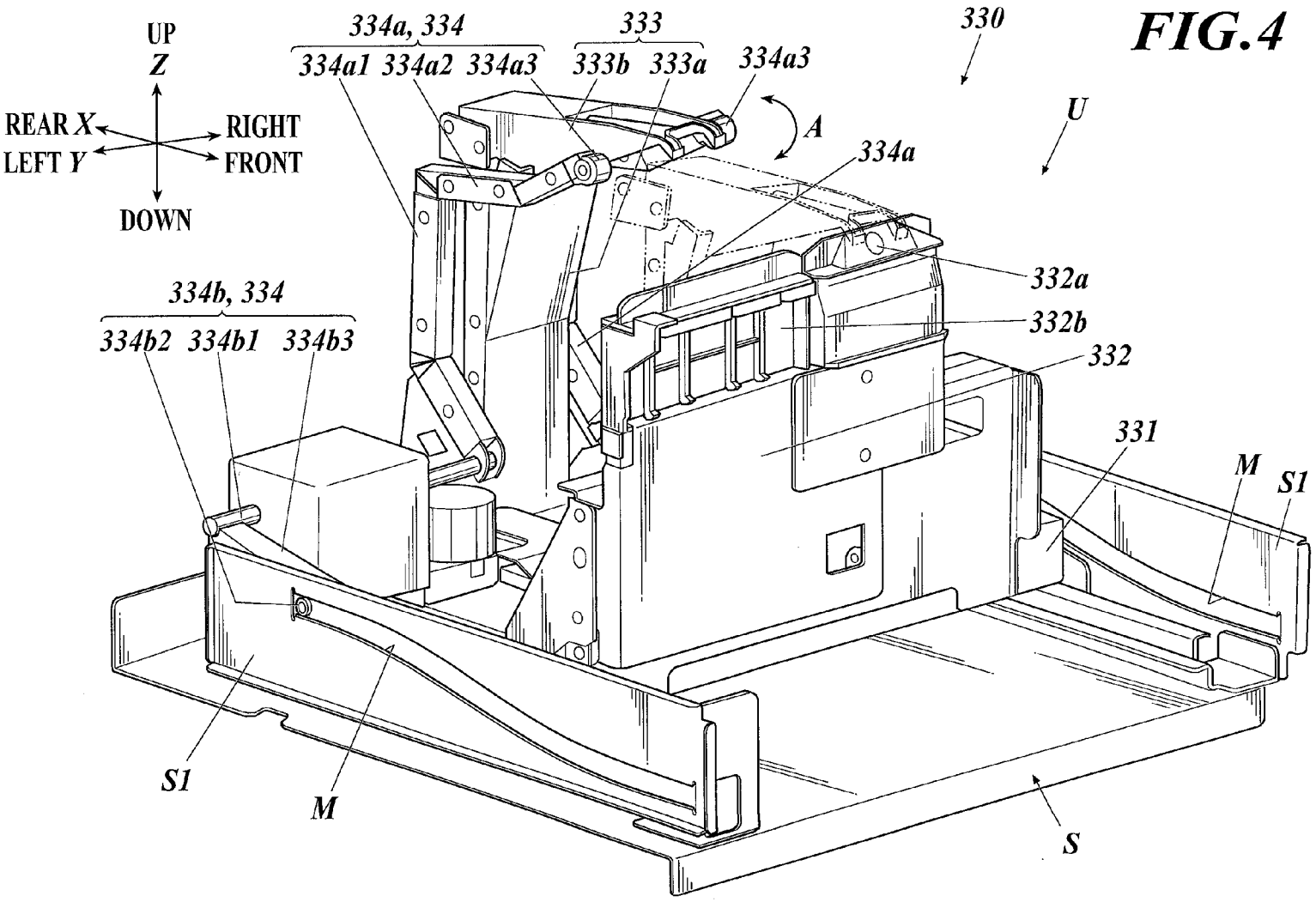
FIG. 4 is a perspective view illustrating an example of a configuration of the conveyance section.

FIG. 2 is a perspective view showing an example of configurations of the saddle stitching section 320 and the sheet conveyance mechanism 330. FIG. 3 is a view for explaining the configuration of the moving saddle 332 in the sheet conveyance mechanism 330. FIG. 4 is a perspective view showing an example of the configuration of the sheet conveyance mechanism 330. In FIG. 4, the two-dot chain line shows a state in which an after-mentioned first pressing section 333 presses the sheet.

As shown in FIG. 2, the saddle stitching section 320 includes a saddle section 321 for stacking and accumulating the sheets which were folded in half by the half folding section 310 and thereafter conveyed in the direction (Y direction) along the folding line thereof, a stapling section 322 which is provided above the saddle section 321, a receiving section 323 provided inside the saddle section 321, and such like.

When a predetermined number of sheets are accumulated on the saddle section 321, staples are inserted along the folding line of the sheet bundle by the cooperation between the stapling section 322 and the receiving section 323 to form a saddle-stitched booklet. The formed saddle-stitched booklet is pushed out to the downstream sheet conveyance mechanism 330 by the alignment section 324 provided at the right end (the end upstream in the conveyance direction) of the saddle section 321.

As shown in FIG. 4, the sheet conveyance mechanism 330 conveys the saddle-stitched booklet pushed out from the saddle stitching section 320 from the rear side to the front side in the X direction and passes the booklet to the clamping section 340 while supporting the saddle-stitched booklet along the folding line from inside.

The sheet conveyance mechanism 330 includes a supporting plate S and a movement unit U which reciprocates in the X direction on the supporting plate S.

The supporting plate S is a plate which supports the movement unit U.

The movement unit U is placed on the upper surface of the supporting plate S so as to be slidable.

A pair of cam plates S1 and S1 extending in the X direction is vertically provided at the right and left ends respectively on the upper surface of the supporting plate S.

Cam grooves M are formed on the respective cam plates S1. The cam grooves M are gradually curved from the upper side to the lower side of the respective cam plates S1 from the rear side to the front side of the cam plates S1, and cam followers 334*b*2 (to be described later) are moved along the respective cam grooves M.

The movement unit U includes a base (conveyance section) 331 which is reciprocatable in the X direction on the supporting plate S and in a flattened rectangular solid shape. The base 331 slides in the X direction by the drive of a first driving section 331*a* (see FIG. 6).

The base 331 supports a moving saddle (supporting section) 332, the first pressing section 333 and a second pressing section 334.

The moving saddle 332 is a plate-like member along Y-Z plane provided at the front end of the base 331. The saddle-stitched booklet pushed out from the saddle stitching section 320 is hung over the moving saddle 332 to be supported at the folding line (stitched part) from below.

As shown in FIG. 3, a detecting section 332*a* such as a sensor is provided at the upper part of the moving saddle 332. The detecting section 332*a* detects sheets after the sheets are supported by the moving saddle 332 and pressed by the first pressing section 333 by the control of a sheet processing control section 505 (to be described later).

The upper part of the moving saddle 332 is also provided with a retreat section 332*b* which contacts the clamping section 340 and retreats downward when passing the saddle-stitched booklet to the clamping section 340. The two-dot chain line in FIG. 3 shows a state in which the retreat section 332*b* retreats.

As shown in FIG. 4, the first pressing section 333 includes a vertical section 333*a* which is vertically provided in the Z direction and a movable section 333*b* extending forward from the upper end of the vertical section 333*a*, for example, and the first pressing section 333 is slidable in the X direction at a central part in the Y direction on the upper surface of the base 331.

Figure 6:
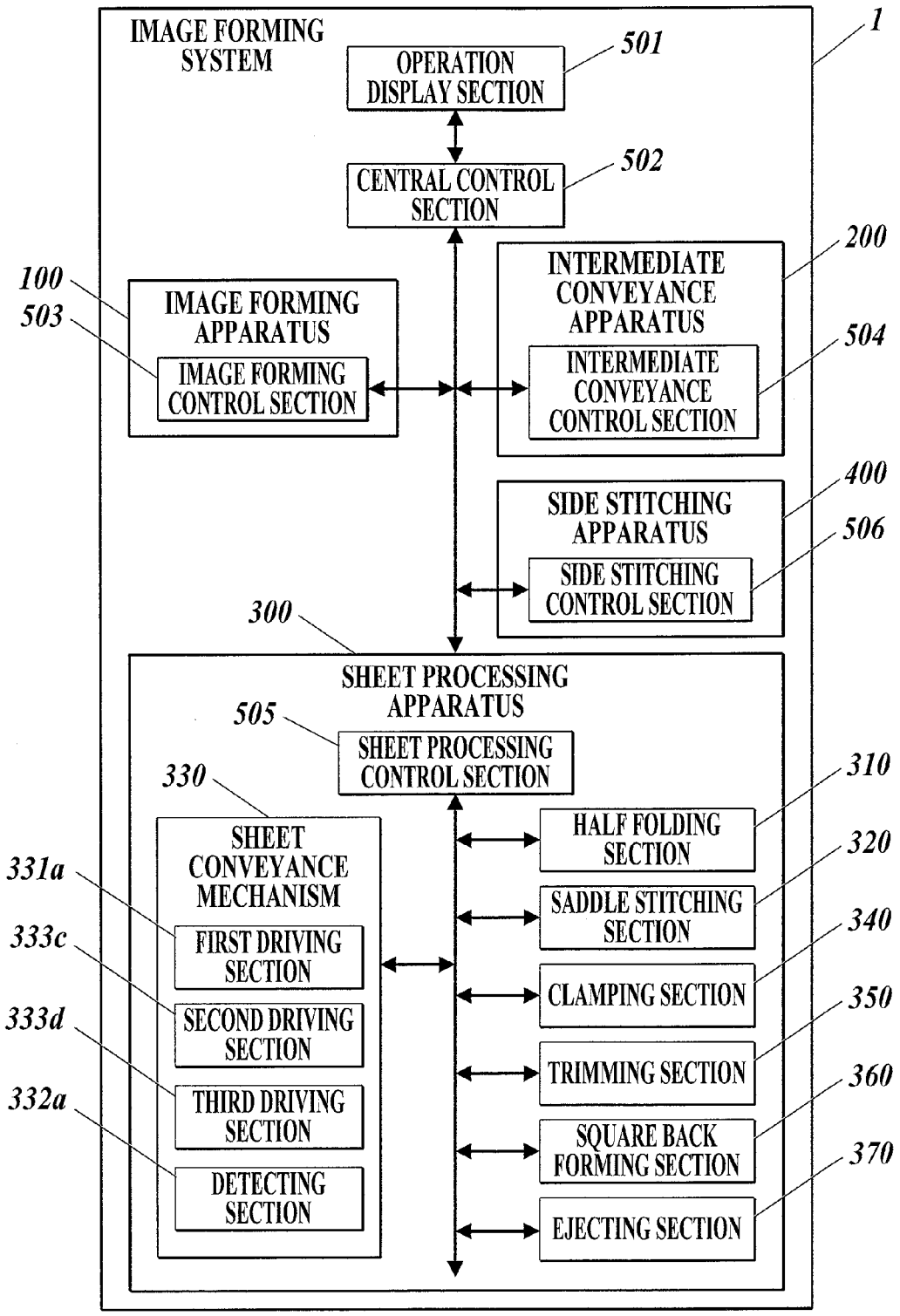
FIG. 6 is a block diagram showing a main configuration according to the operation control in the image forming system.

The vertical section 333*a* slides on the upper surface of the base 331 by the drive of a second driving section 333*c* (see FIG. 6).

The base end of the movable section 333*b* is connected to the upper end of the vertical section 333*a* so as to be rotatable and the distal end thereof is curved downward and bifurcated. When rotated, the distal end of the movable section 333*b* contacts positions not overlapping the detecting section 332*a* provided on the moving saddle 332.

The movable section 333*b* is rotated in the arrow A direction of FIG. 4 by the drive of a third driving section 333*d* (see FIG. 6).

When the saddle-stitched booklet is held on the moving saddle 332, the vertical section 333*a* slides forward on the base 331, the movable section 333*b* is rotated downward, and thereby the distal end thereof can press the central portion of the folding line of the saddle-stitched booklet from above.

In FIG. 4, the two-dot chain line shows a state in which the first pressing section 333 presses the saddle-stitched booklet.

The second pressing section 334 includes a pair of arms 334*a* and 334*a* vertically provided at positions sandwiching the first pressing section 333 along the Y direction at the rear end of the base 331, and connecting sections 334*b* and 334*b* provided at the respective lower ends of the arms 334*a* and 334*a*, for example.

The pair of arms 334*a* and 334*a* (and the connecting sections 334*b* and 334*b*) is bilaterally symmetric with respect to the first pressing section 333 and operates so as to incline gradually as the base 331 moves forward.

Each of the arms 334*a* includes a standing section 334*a*1 standing to the height nearly same as the vertical section 333*a* of the first pressing section 333, and an extending section 334*a*2 extending forward from the upper end of the standing section 334*a*1. The extending section 334*a*2 is inclined so as to be slightly directed upward from the central portion to the end portion thereof, and the end portion is provided with a contacting section 334*a*3 including a curved surface. The standing section 334*a*1 and the extending section 334*a*2 operate in an integrated manner to maintain a same angle.

Each of the connecting sections 334*b* includes a shaft 334*b*1 connected to the lower end of the standing section 334*a*1, a cam follower 334*b*2 interlocked with the cam groove M of the cam plate S1, and a connecting piece 334*b*3 connecting the shaft 334*b*1 and the cam follower 334*b*2.

When the cam followers 334*b*2 move along the respective cam grooves M, the connecting pieces 334*b*3 and the shafts 334*b*1 are rotated accordingly, and thus, change the angle at which the arms 334*a* are inclined.

By the arms 334*a* gradually inclining forward as the base 331 moves forward, the second pressing section 334 can press the surface at rear side in conveyance direction of the saddle-stitched booklet with the contacting sections 334*a*3 located at the distal end thereof.

Figure 5:
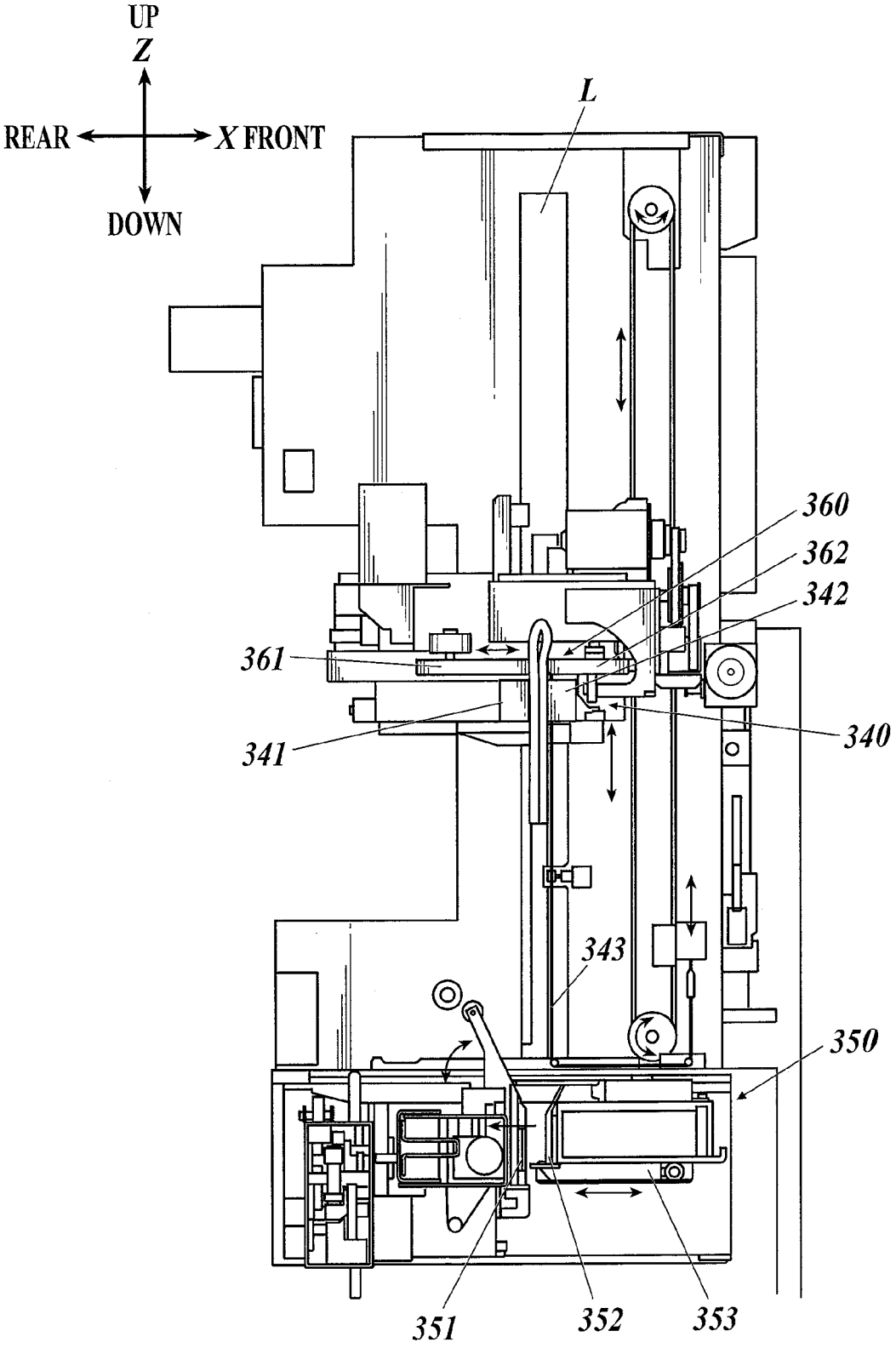
FIG. 5 is a view illustrating an example of configurations of a clamping section, an edge trimming section and a square back forming section of the sheet processing apparatus.

FIG. 5 is a view showing an example of configurations of the clamping section 340, trimming section 350 and square back forming section 360 in the sheet processing apparatus.

As shown in FIG. 5, the clamping section 340 is provided above the trimming section 350. The clamping section 340 includes two sandwiching members 341 and 342, and sandwiches the saddle-stitched booklet conveyed from the rear side to the front side by the sheet conveyance mechanism 330 as described above.

As a third pressing member, a plurality of (here, six) guide wires 343 are provided in parallel with each other along the Y direction at the sandwiching member 342 which is located forward among the two sandwiching members 341 and 342. The guide wires 343 are provided so as to be extending along the Z direction and in parallel with each other for an equal distance.

Figure 10:
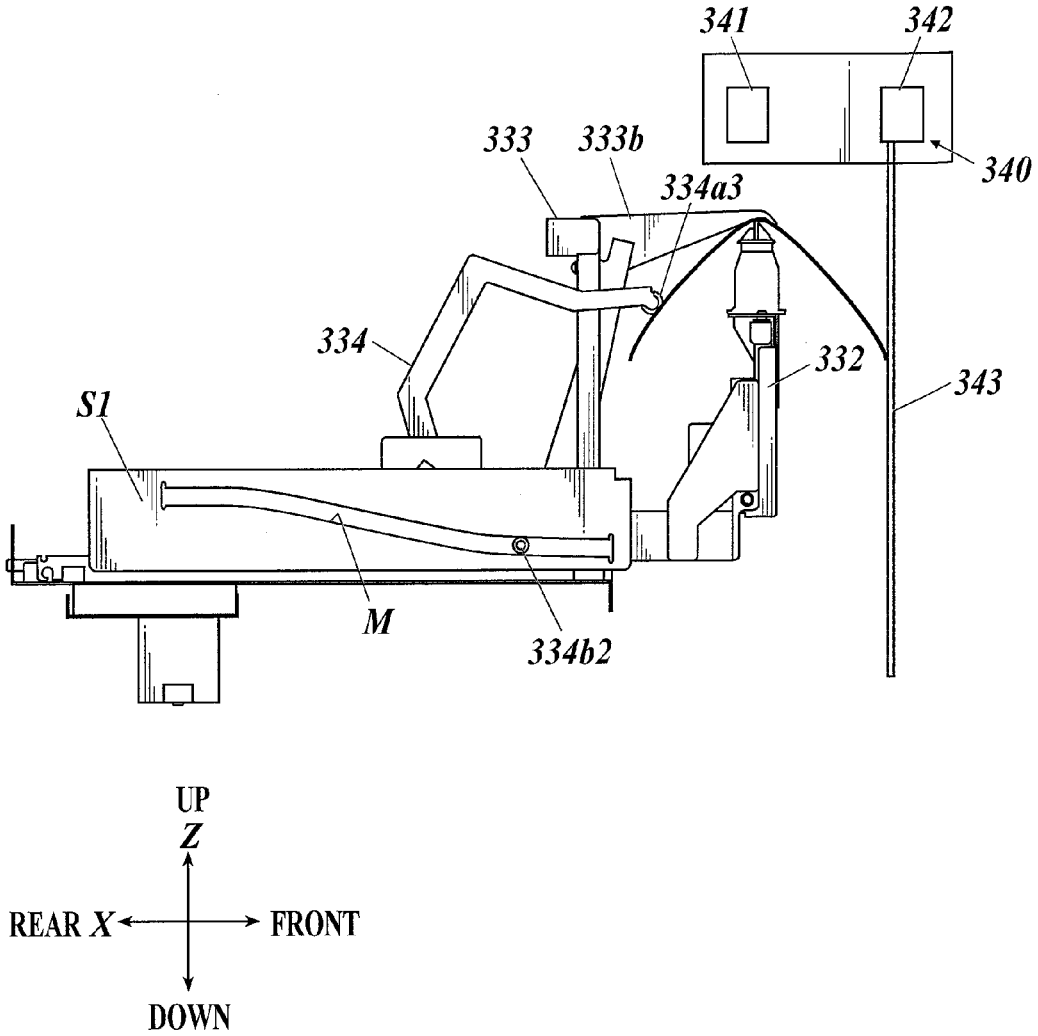
FIG. 10 is a view for explaining operation of the conveyance section.
Figure 11:
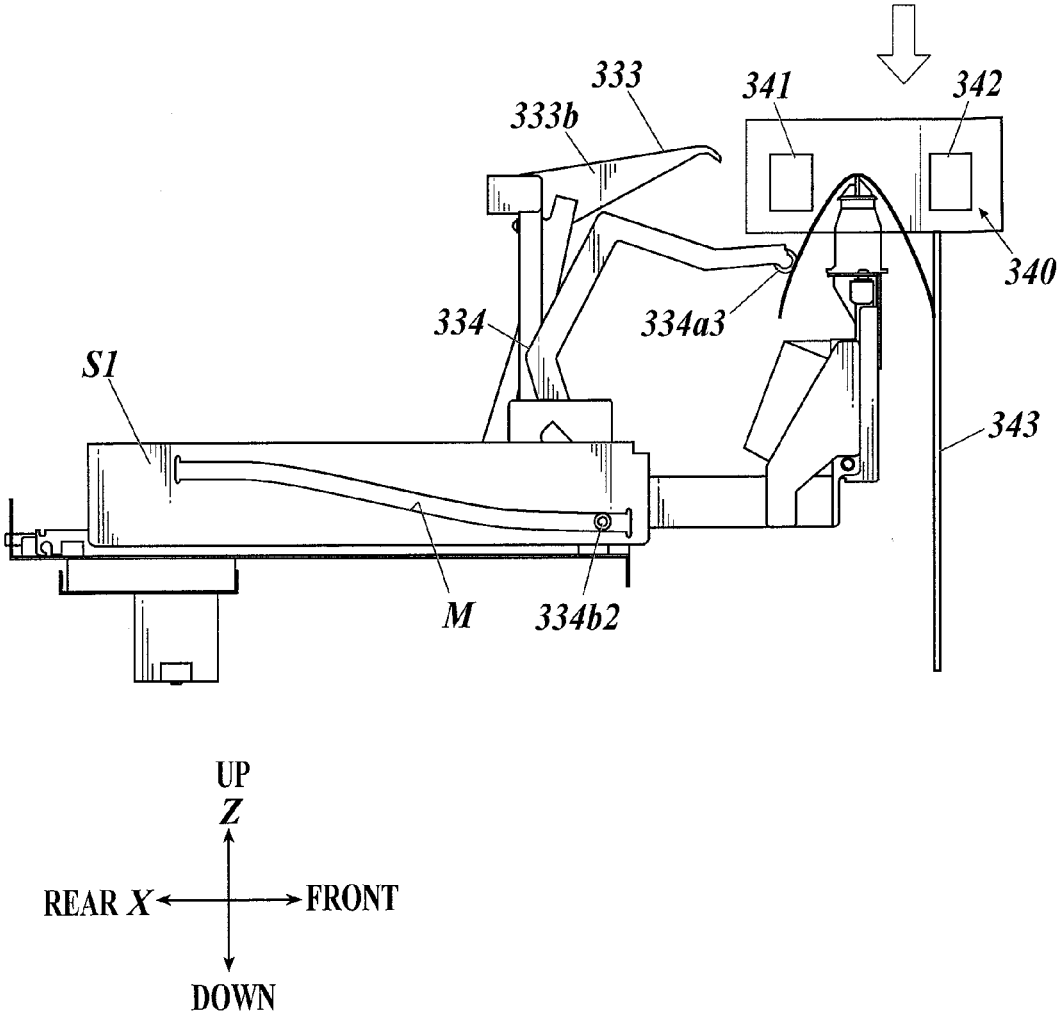
FIG. 11 is a view for explaining operation of the conveyance section.

The guide wires 343 are provided at positions contacting the front surface in conveyance direction of the saddle-stitched booklet when conveying the saddle-stitched booklet from the rear side to the front side by the sheet conveyance mechanism 330 (see FIGS. 10 and 11).

Accordingly, the saddle-stitched booklet conveyed by the sheet conveyance mechanism 330 is sandwiched between the second pressing section 334 and the guide wires 343 as advancing forward, and thus folded.

The clamping section 340 is lowered with the saddle-stitched booklet located between the clamping section 340 and the trimming section 350, and thereby the two sandwiching members 341 and 342 are positioned so as to sandwich, around the folding line, the saddle-stitched booklet supported by the moving saddle 332.

When the clamping section 340 is lowered to contact the upper part of the moving saddle 332 and the retreat section 332*b* at the upper part of the moving saddle 332 retreats, a lifter plate in the clamping section 340 not shown in the drawings supports the saddle-stitched booklet so as to lift it up from below while the two sandwiching members 341 and 342 move so as to approach each other, and thereby the saddle-stitched booklet is sandwiched. The retreat section 332*b* provided on the moving saddle 332 prevents the operation of the lifter plate from being disturbed.

After the two sandwiching members 341 and 342 sandwich the saddle-stitched booklet, the base 331 (moving saddle 332) retreats backward.

Thereafter, the clamping section 340 can make the edges of the saddle-stitched booklet enter the trimming section 350 by being lowered along a guide rail L provided along the Z direction.

The trimming section 350 includes trimming sandwiching sections 351 and 352 to make the edges of the saddle-stitched booklet advance to a predetermined position between the trimming sandwiching sections 351 and 352. A trimming blade 353 is operated and the edge of the saddle-stitched booklet is trimmed. Thus, unaligned edges of the saddle-stitched booklet are aligned.

The square back forming section 360 is loaded on the clamping section 340.

The square back forming section 360 is configured by including holding plates 361 and 362, a roller not shown in the drawings) and such like. After the holding plates 361 and 362 sandwich the saddle-stitched booklet therebetween, the folding line is flattened by the roller. Thus, the folding line is formed in a square shape.

The ejecting section 370 ejects the saddle-stitched booklet which was trimmed and/or had the back formed in a square shape. The ejecting section 370 may eject a saddle-stitched booklet to which none of the trimming and square back forming is performed.

Returning to FIG. 1, the side stitching apparatus 400 performs side stitching to a plurality of sheets of paper.

Specifically, the side stitching apparatus 400 includes a stapling section which staples the plurality of sheets received from the sheet processing apparatus 300, a page end trimming section which performs end trimming to cut off a part of end portions parallel to the spine of the plurality of stapled sheets so as to align the end portions, and an ejecting section which ejects the sheets after processing by the connected apparatuses, for example.

The side stitching apparatus 400 can eject the sheets received from the sheet processing apparatus 300 without performing a part or all of the various processes by the side stitching apparatus 400.

Next, the operation control in the image forming system 1 will be described.

FIG. 6 is a block diagram showing the main configuration according to the operation control in the image forming system 1.

The image forming system 1 includes an operation display section 501 which receives input operation from a user according to the operation in the image forming system 1 and performs display according to the operation in the image forming system 1, a central control section 502 which controls operations in the entire image forming system 1, an image forming control section 503 which controls operations of the image forming apparatus 100, an intermediate conveyance control section 504 which controls operations of the intermediate conveyance apparatus 200, a sheet processing control section (control section) 505 which controls operations of the sheet processing apparatus 300 and a side stitching control section 506 which controls operations of the side stitching apparatus 400.

The operation display section 501 includes, for example, a touch panel type operation display section or switches and keys for various types of input to send a signal according to the input from the user to the central control section 502.

Each of the central control section 502, the image forming control section 503, the intermediate conveyance control section 504, the sheet processing control section 505 and the side stitching control section 506 includes a CPU (Central Processing Unit), a RAM (Random Access Memory), a ROM (Read Only Memory) and such like to read out a software program and various types of data according to processing and execute the processing.

The central control section 502 sets various types of conditions in the image forming system 1 in accordance with the input from the user via the operation display section 501.

The setting conditions include, for example, a sheet size and the number of colors to form images (for example, full-color, gray scale or monochrome), the number of sheets to be folded in half, a nip pressure for half folding, the number of sheets in a single booklet to be saddle-stitched, the type, size and basis weight of sheets to be saddle-stitched, the number of staples to be inserted into the folding line of sheets for saddle stitching, a position to insert the staples (stapling position) for saddle stitching, whether to trim the end portions which are margins, and the width of the end portions to be trimmed.

Then, the central control section 502 outputs instructions to perform processing according to the setting to the image forming control section 503, the intermediate conveyance control section 504, the sheet processing control section 505 and the side stitching control section 506. The control sections control operations of the respective apparatuses to be controlled according to the instructions.

For example, the central control section 502 outputs an instruction for performing half folding, saddle stitching, edge trimming, square back forming and such like to the sheet processing control section 505.

In response to this, the sheet processing control section 505 controls the half folding section 310, the saddle stitching section 320, the clamping section 340, the trimming section 350 and the square back forming section 360 to perform the processing.

At this time, the sheet processing control section 505 controls the sheet conveyance mechanism 330 to pass the saddle-stitched booklet from the saddle stitching section 320 to the clamping section 340.

The operation of sheet conveyance mechanism 330 for conveying the saddle-stitched booklet in the embodiment will be described.

Such operation is executed under control of the sheet processing control section 505 by the instruction output from the central control section 502.

Figure 7:
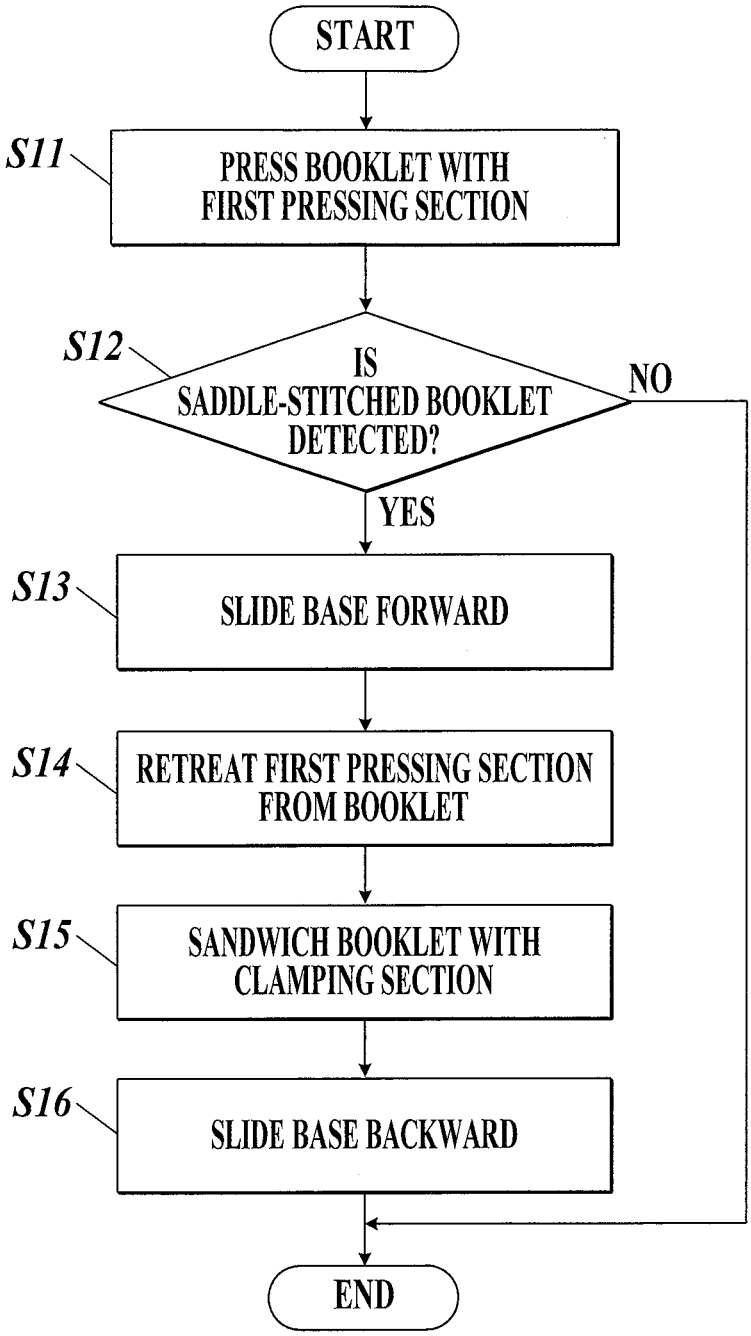
FIG. 7 is a flowchart showing a conveyance operation of the saddle-stitched booklet by the conveyance section.
Figure 8:
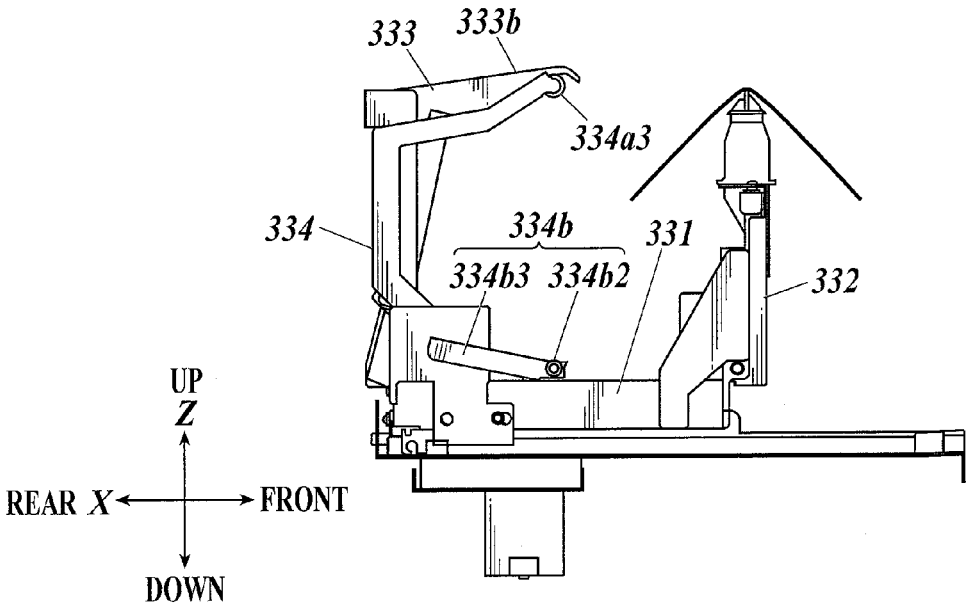
FIG. 8 is a view for explaining operation of the conveyance section.

FIG. 7 is a flowchart showing the conveyance operation of saddle-stitched booklet by the sheet conveyance mechanism 330. FIGS. 8 to 11 are schematic views for showing a temporal change of the movement unit U. In FIG. 8, the illustration of cam plate S1 is omitted.

Figure 9:
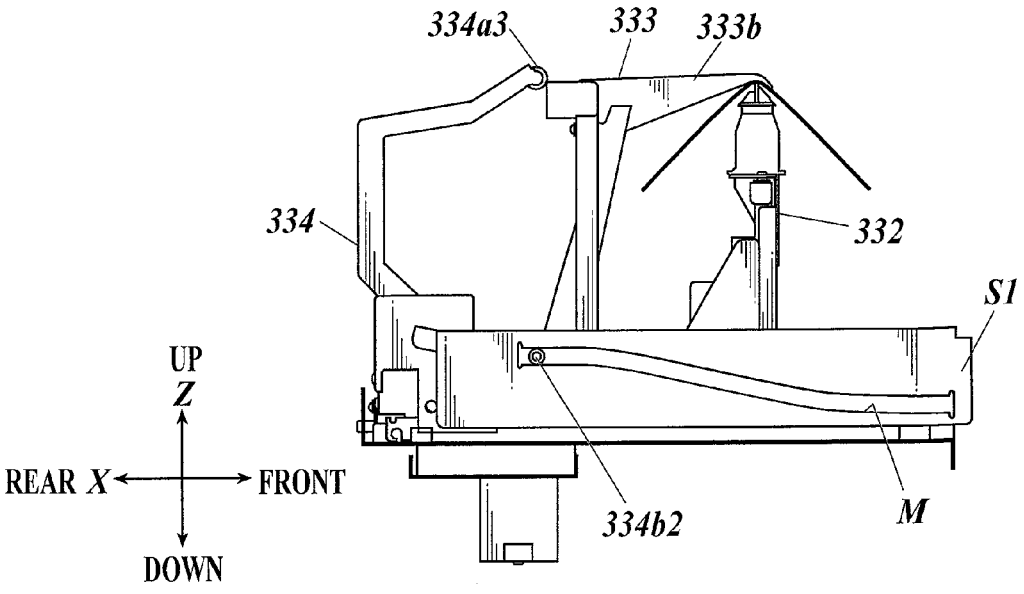
FIG. 9 is a view for explaining operation of the conveyance section.

First, when the moving saddle 332 supports the saddle-stitched booklet (see FIG. 8), the sheet processing control section 505 presses the saddle-stitched booklet from above with the first pressing section 333 in step S11 (see FIG. 9).

Specifically, the sheet processing control section 505 drives the second driving section 333*c* to slide the vertical section 333*a* of the first pressing section 333 forward, thereafter drives the third driving section 333*d* to rotate the movable section 333*b* of the first pressing section 333 downward, and presses the saddle-stitched booklet from above.

Next, in step S12, the sheet processing control section 505 detects whether there is a saddle-stitched booklet on the moving saddle 332.

Specifically, the sheet processing control section 505 controls the detecting section 332*a* to detect the sheets at a predetermined timing after the first pressing section 333 presses the saddle-stitched booklet.

The saddle-stitched booklet supported by the moving saddle 332 may not be detected when it is open or comes off the moving saddle 332; however, the above control prevents the incorrect detection since the saddle-stitched booklet is detected while being pressed from above.

Also, since the end of the movable section 333*b* is bifurcated, the detecting section 332*a* and the movable section 333*b* do not interfere with each other, and thus, incorrect detection is prevented.

If it is not determined that there is a saddle-stitched booklet on the moving saddle 332 (step S12: NO), the sheet processing control section 505 ends the processing.

On the other hand, if it is determined that there is a saddle-stitched booklet on the moving saddle 332 (step S12: YES), the sheet processing control section 505 slides the base 331 forward in the following step S13.

Specifically, the sheet processing control section 505 drives the first driving section 331*a* to slide the base 331 forward.

When the base 331 is moved, the arms 334*a* in the second pressing section 334 accordingly inclines forward gradually and the contacting sections 334*a*3 of the respective arms 334*a* press the rear surface in conveyance direction of the saddle-stitched booklet.

When the base 331 further moves forward for a predetermined distance or more, the front surface in conveyance direction of the saddle-stitched booklet contacts the guide wires 343 to be pressed.

Accordingly, as advancing forward, the conveyed saddle-stitched booklet is sandwiched between the second pressing section 334 and the guide wires 343 to be folded while maintaining the symmetrical shape with respect to the folding line (see FIG. 10).

Next, in step S14, the sheet processing control section 505 makes the first pressing section 333 retreat from the saddle-stitched booklet.

Specifically, the sheet processing control section 505 drives the third driving section 333*d* to rotate the movable section 333*b* of the first pressing section 333 upward so as to retreat from the saddle-stitched booklet.

Accordingly, even when the clamping section 340 is lowered in the following process, the clamping section 340 does not interfere with the first pressing section 333 (see FIG. 11).

Next, in step S15, the sheet processing control section 505 sandwiches the saddle-stitched booklet with the clamping section 340.

Specifically, the sheet processing control section 505 sandwiches the saddle-stitched booklet with the two sandwiching members 341 and 342.

At this time, since the saddle-stitched booklet is sandwiched between the second pressing section 334 and the guide wires 343, the saddle-stitched booklet can be passed to the clamping section 340 without losing the symmetrical shape.

Next, in step S16, the sheet processing control section 505 moves the base 331 backward to return to the initial position and ends the processing.

As described above, according to the embodiment, the sheet processing apparatus 300 includes a moving saddle 332 over which mountain-folded sheets having a folding line at the central portion are hung to be supported from below, a base 331 which conveys the sheets supported by the moving saddle 332 in a direction orthogonal to the folding line in a plane including the folding line, a sheet processing control section 505 which controls the operation of base 331 conveying the sheets, a first pressing section 333 which presses the folding line of sheets supported by the moving saddle 332 from above and a second pressing section 334 which presses the sheets from the rear side in the advancing direction when the base 331 conveys the sheets.

Thus, since the first pressing section 333 presses the folding line of the saddle-stitched booklet from above, it is possible to prevent the sheets from falling down from the moving saddle 332 during the conveyance without lowering the conveyance speed.

The sheets possibly come off the moving saddle 332 to be shifted due to the inertia during conveyance even when the folding line of the saddle-stitched booklet is pressed from above; however, such sheet shifting can be prevented since the second pressing section 334 presses the sheets from the rear side in the advancing direction.

Thus, the saddle-stitched booklet can be conveyed in a vertical state without lowering productivity, falling down from the placement section nor shifting the folding line.

According to the embodiment, the sheet processing apparatus 300 includes guide wires 343 pressing the sheets from the front side in advancing direction when the base 331 conveys the sheets.

Thus, while being conveyed, the sheets can be maintained in the symmetrical shape with respect to the folding line.

According to the embodiment, the sheet processing control section 505 makes the first pressing section 333 retreat from the folding line of sheets at the position where the sheet conveyance by the base 331 is completed, and presses the sheets with the second pressing section 334 and the guide wires 343.

Thus, since the sheets maintain in a symmetrical shape with respect to the folding line even after the first pressing section 333 retreats from the folding line of sheets, the following processes can be started with the sheets which are not shifted.

According to the embodiment, the sheet processing apparatus 300 includes a trimming section 350 which trims the edges of the sheets conveyed by the base 331.

Thus, since the edge trimming is performed to the sheets which were conveyed without shifting, the edge trimming can be accurately performed.

According to the embodiment, the sheet processing apparatus 300 includes a square back forming section 360 which squeezes the folding line of sheets conveyed by the base 331 to be flat and form a square shape.

Thus, since the folding line is formed in the square shape with respect to the sheets conveyed without shifting, the square back forming can be accurately performed.

According to the embodiment, the sheet processing apparatus 300 includes a clamping section 340 which sandwiches, around the folding line, the sheets conveyed by the base 331 and lifts it up from the moving saddle 332. The moving saddle 332 includes a retreat section 332*b* which contacts the clamping section 340 and retreats when the clamping section 340 lifts up the sheets.

Thus, the sheets can be smoothly passed from the base 331 to the clamping section 340.

According to the embodiment, the moving saddle 332 includes a detecting section 332*a*, the first pressing section 333 presses the sheets supported by the moving saddle 332 at positions not overlapping the detecting section 332*a*, and the sheet processing control section 505 starts detecting the sheets with the detecting section 332*a* after the first pressing section 333 presses the sheets.

Thus, incorrect detection can be prevented.

The first pressing section may have any configuration and is not limited to the above configuration as long as it can press the folding line of sheets from above. For example, though the first pressing section in the embodiment presses the central portion of the folding line of saddle-stitched booklet from above, it may press the both end portions of the folding line.

The second pressing section may have any configuration and is not limited to the above configuration as long as it can press the sheets from the rear side in advancing direction when conveying the sheets. For example, the second pressing section in the embodiment contacts two positions on the rear surface in advancing direction of the sheets while conveying the sheets; however, it may press three or more positions.

The third pressing section may have any configuration and is not limited to the above configuration as long as it can press the sheets from the front side in advancing direction while conveying the sheets. For example, though the guide wires are illustrated as the third pressing section in the embodiment, the third pressing section may be one or a plurality of plate-like members or such like having a predetermined width.

The entire disclosure of Japanese Patent Application No. 2013-184044 filed on Sep. 5, 2013 including description, claims, drawings, and abstract are incorporated herein by reference in its entirety.

What is claimed is:

1. A sheet processing apparatus comprising:

a supporting section over which a sheet is hung to be supported from below, the sheet being folded in a mountain shape with a folding line formed at a central portion;

a conveyance section which conveys the sheet supported by the supporting section in a direction orthogonal to the folding line in a horizontal plane including the folding line;

a control section which controls a sheet conveyance operation by the conveyance section; and a first pressing section which presses the folding line of the sheet supported by the supporting section from above during conveyance of the sheet by the conveyance section.

2. The sheet processing apparatus according to claim 1, further comprising a trimming section which trims an edge of the sheet conveyed by the conveyance section.

3. The sheet processing apparatus according to claim 1, further comprising a square back forming section which squeezes the folding line of the sheet conveyed by the conveyance section so as to be flat to form a square shape.

4. The sheet processing apparatus according to claim 1, further comprising a clamping section which sandwiches, around the folding line, the sheet conveyed by the conveyance section and lifts up the sheet from the supporting section, wherein the supporting section includes a retreat section which contacts with the clamping section and retreats when the clamping section lifts up the sheet.

5. The sheet processing apparatus according to claim 1, wherein:

the supporting section includes a detecting section which detects the sheet, the first pressing section presses the sheet supported by the supporting section at a position not overlapping the detecting section, and the control section makes the detecting section start detecting the sheet after the first pressing section presses the sheet.

6. An image forming system, comprising:

an image forming apparatus which forms an image on a sheet; and the sheet processing apparatus according to claim 1 which is connected to the image forming apparatus, the sheet being folded in the mountain shape with the folding line formed at the central portion after the image forming apparatus forms the image on the sheet.

7. The sheet processing apparatus according to claim 1, further comprising:

a second pressing section which presses the sheet from a rear side in an advancing direction when the conveyance section conveys the sheet.

8. The sheet processing apparatus according to claim 7, further comprising a third pressing section which presses the sheet from a front side in the advancing direction when the conveyance section conveys the sheet.

9. The sheet processing apparatus according to claim 8, wherein the control section makes the first pressing section retreat from the folding line at a position where sheet conveyance by the conveyance section is completed, and makes the second pressing section and the third pressing section press the sheet.

* * * * *